US005655469A

United States Patent [19]

Herbach et al.

[11] Patent Number: 5,655,469

[45] Date of Patent: Aug. 12, 1997

[54] EMBROIDERY FRAME WITH A CLAMPING DEVICE

[75] Inventors: Mathias Herbach, Pfinztal; Helmar Holl, Karlsruhe, both of Germany

[73] Assignee: G.M. Pfaff Aktiengesellschaft, Kaiserslautern, Germany

[21] Appl. No.: 648,336

[22] Filed: May 15, 1996

[30] Foreign Application Priority Data

May 19, 1995 [DE] Germany ..... 295 08 369.7

[51] Int. Cl.[6] ..... D05C 9/04

[52] U.S. Cl. ..... 112/103; 38/102.2

[58] Field of Search ..... 112/103, 470.06, 112/470.14, 475.18; 38/102.2, 102.4; 101/127.1; 160/371, 372, 380

[56] References Cited

U.S. PATENT DOCUMENTS

| | | | |
|---|---|---|---|
| 586,947 | 7/1897 | Bucklin | 38/102.2 |
| 1,249,057 | 12/1917 | Finley | 38/102.2 |
| 5,018,460 | 5/1991 | Schilling et al. | 38/102.2 X |

FOREIGN PATENT DOCUMENTS

| | | | |
|---|---|---|---|
| 1032890 | 2/1989 | Japan | 112/103 |
| 1239151 | 9/1989 | Japan | 112/103 |
| 2-264059 | 10/1990 | Japan . | |

*Primary Examiner*—Ismael Izaguirre
*Attorney, Agent, or Firm*—McGlew and Tuttle

[57] ABSTRACT

An embroidery frame, comprising a closed inner frame and an outer frame open at a point and a clamping device provided on the outer frame with one laterally projecting projection each at each of the two ends of the outer frame. A stud is provided that can be fixed at one projection and a screwing device is provided that cooperates with the stud and is supported at the other projection. The stud is displaceably guided within one projection at a closely spaced location from the outside of the frame and is supported with a head on a stop face of the projection. The other end of the stud is rigidly connected to a sliding block, which is longitudinally displaceably accommodated within a guide provided in the other projection. A tie rod is led out of the other projection extending obliquely toward the outside of the frame. The tie rod is pivotably arranged at the sliding block. The screw device is formed by a collet, which is arranged on the threaded section of the tie rod and is supported on a shoulder of the other projection. The shoulder extends essentially at right angles to the longitudinal axis of the said tie rod.

2 Claims, 1 Drawing Sheet

EMBROIDERY FRAME WITH A CLAMPING DEVICE

FIELD OF THE INVENTION

The present invention pertains to an embroidery frame with a closed inner frame and an outer frame open at a point and a clamping device provided on the outer frame with a projection laterally projecting at each of the two ends of the outer frame, with a stud that can be fixed at one projection and with a screwing means that cooperates with the stud and is supported at the other projection.

BACKGROUND OF THE INVENTION

Embroidery frames, which usually comprise a closed inner frame and an outer frame, which is opened at one point, and have a clamping device, by means of which a clamping force suitable for the reliable fixation of the clamped workpiece can be set between the inner frame and the outer frame, are used to hold the workpiece to be processed for performing embroidery work on sewing machines and smaller embroidery machines. The clamping device comprises, in general, two projections, which project laterally at the ends of the outer frame, a threaded bolt fixed at one projection, and a threaded nut, which is screwed onto the said threaded bolt and is supported at the other projection.

In order not to exert an excessive bending moment on the ends of the outer frame by the threaded bolt arranged at a spaced location from the outer frame during the setting of the clamping force (this would lead to a deformation of the outer frame and consequently to a nonuniform distribution of the clamping force) it is sought that the distance between the threaded bolt and the outside of the outer frame be kept as small as possible. However, this possibility is limited by the fact that the threaded nut should have a shape and size as well as a position in relation to the outside of the frame which are favorable for grasping, because its diameter should not be too small for applying the necessary setting forces, and it should also possibly be located at a certain distance from the outside of the frame in order to be able to be grasped reliably.

This requirement can be met without any special problems in the case of round embroidery frames, because the free end of the threaded nut is located at an increasing distance from the circular outside of the outer frame with increasing length.

For rectangular embroidery frames, laid-open Japanese Patent Application JP-P Hei-2-264 059 suggests that the fastening device be arranged at one of the four corners of the frame, as a result of which the embroidery frame projects into the free space in a readily accessible manner. However, such an arrangement of the fastening device or of the point of separation of the outer frame is associated with the disadvantage of a very nonuniformly distributed clamping force between the outer frame and the inner frame.

SUMMARY AND OBJECTS OF THE INVENTION

The primary object of the present invention is therefore to provide an easy-to-operate clamping device for essentially rectangular embroidery frames which guarantees the most uniform possible distribution of the clamping forces between the outer frame and the inner frame.

According to the invention, an embroidery frame is provide with a closed inner frame and an outer frame open at a point and a clamping device provided on the outer frame with one laterally projecting projection each at each of the two ends of the outer frame. A stud is preferably fixed at one projection and a screwing means that cooperates with the stud is preferably supported at the other projection. The stud is displaceably guided within one of the projections at a closely spaced location from the outside of the frame. The stud is supported with a head on a stop face of the projection. The other end of the stud is rigidly connected to a sliding block, which is longitudinally displaceably accommodated within a guide provided in the other projection. A tie rod, which is led out of the other projection extending obliquely toward the outside of the frame, is pivotably arranged at the sliding block. The screw means is formed by a collet, which is arranged on a threaded section of the tie rod and is supported on a shoulder of the one projection. The shoulder extends essentially at right angles to the longitudinal axis of the tie rod.

By arranging a tie rod extending obliquely in relation to the outside of the frame between the bolt of the clamping device and the collet, the clamping device is located at a relatively great distance from the outside of the frame and can therefore be handled in a very simple manner without hindrance. This also makes it possible to arrange the bolt and the sliding block at an especially closely spaced location from the outside of the frame, as a result of which only small bending moments, which do not adversely affect the distribution of the clamping forces between the outer frame and the inner frame, will occur at the ends of the outer frame.

The embroidery frame in accordance with the invention, preferably designed with the head of the stud accommodated in a stepped hole of the said corresponding projection. The sliding block is preferably secured against rotation within its guide. The shoulder of the projection, which shoulder is associated with the collet, preferably has an arched surface.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
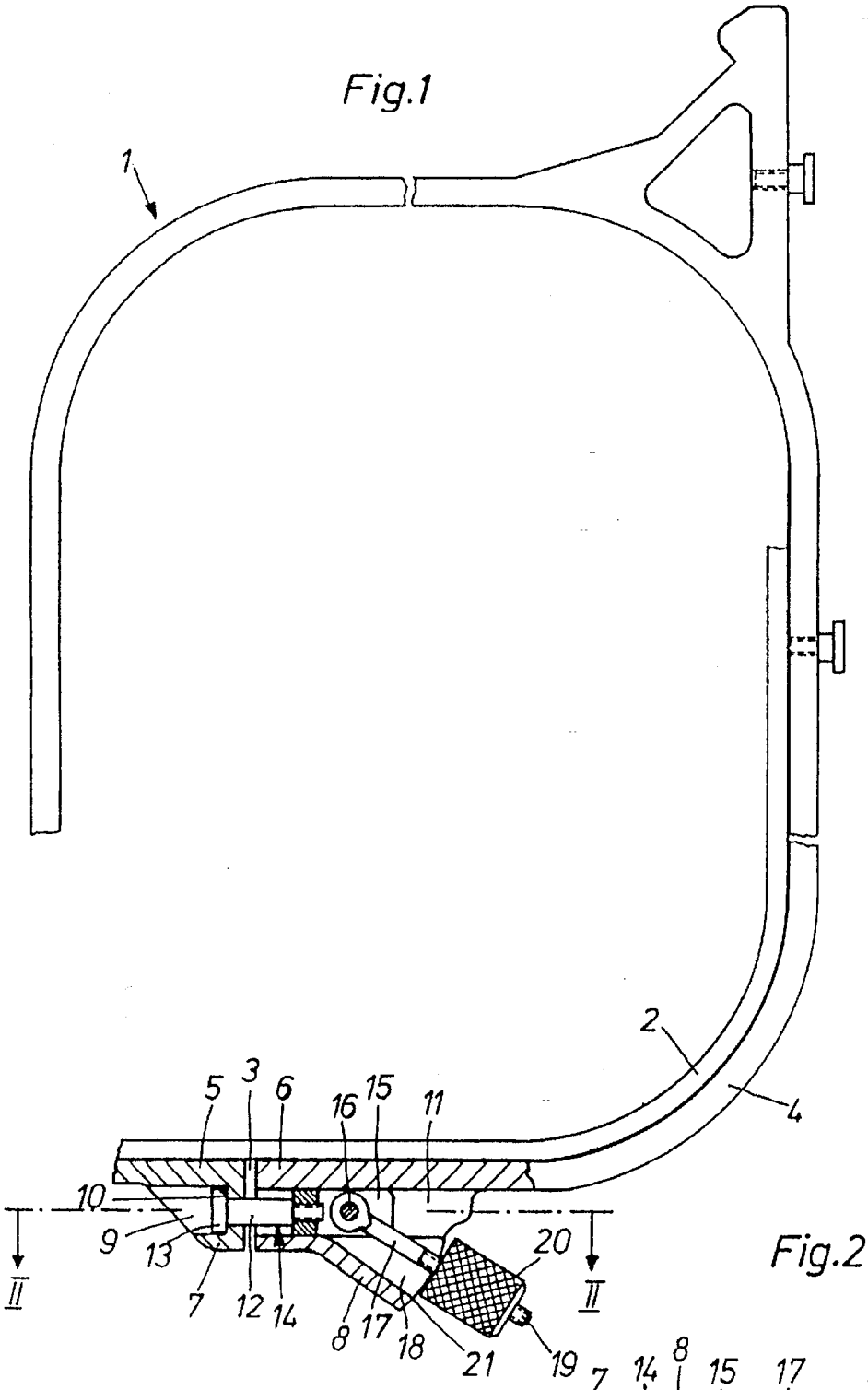
FIG. 1 is a partially cutaway top view of an embroidery frame with a clamping device.
Figure 2:
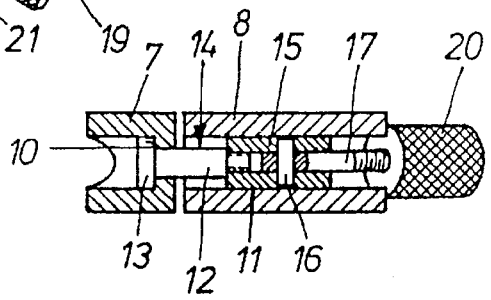
FIG. 2 is a sectional view according to line II—II in FIG. 1.

The essentially rectangular embroidery frame 1 comprises a closed inner frame 2 and an outer frame 4, which is open at a point 3. The point 3 is located essentially in the middle between two corners of the embroidery frame 1. One laterally projecting projection 7 is provided at the end 5 of the outer frame 4, and one laterally projecting projection 8 is provided at the end 6 of the outer frame 4. The projection 7 contains a stepped hole 9 with a stop face 10. The larger diameter of the stepped hole 9 touches the outside of the outer frame 4. The projection 8 contains a continuous guide channel 11 corresponding to the stepped hole 9, with a rectangular cross section.

The shaft 12 and the head 13 of a longitudinally displaceably mounted stud 14 are accommodated in the projection 7.

The stud 14 is screwed to a sliding block 15 mounted longitudinally displaceably in the guide channel 11, and it forms one unit with this. The sliding block 15 has a square cross section and is therefore accommodated in the guide channel 11 secured against rotation.

The sliding block 15 is also designed as a fork head and is connected to a tie rod 17 extending obliquely in the horizontal plane by means of a pin 16 in an articulated manner. The tie rod 17 extends in a slot 18 of an obliquely extending section of the projection 8. A surface of the projection 8 extending essentially at right angles to the longitudinal axis of the tie rod 17 has an arched shape and forms a shoulder 21 for a collet 20 screwed onto a threaded section 19 of the tie rod 17.

Before a workpiece is clamped in the embroidery frame 1, the outer frame 4, which initially lies alone on a support surface of the machine, is preset to the desired width. The collet 20 is now rotated by a corresponding amount, and it is linearly supported in a corresponding area of the shoulder 21, depending on the oblique position of the tie rod 17. Together with the workpiece, the inner frame 2 is then tightly pressed into the preset outer frame 4, as a result of which the workpiece is tightly tensioned within the embroidery frame 1 and the section of the workpiece located between the frame parts 2, 4 is fixed in a frictionally engaged manner.

While a specific embodiment of the invention has been shown and described in detail to illustrate the application of the principles of the invention, it will be understood that the invention may be embodied otherwise without departing from such principles.

What is claimed is:

1. An embroidery frame, comprising:

a closed inner frame;

an outer frame open at a point; and a clamping device provided on the outer frame with one laterally projecting projection at one end of said outer frame and another laterally projecting projection at another end of said outer frame, with a stud fixable with one projection, with screwing means cooperating with said stud, with a sliding block and with a tie rod having a threaded section, said one projection having a stop face and said another projection defining a sliding block guide and a shoulder, said screwing means being supported at said another projection, said stud having a stud head and an end opposite said stud head, said stud being displaceably guided within said one projection at a closely spaced location from an outside of said frame and said stud being supported with said stud head on said stop face, said end opposite said stud head being rigidly connected to said sliding block, said sliding block being longitudinally displaceably accommodated within said sliding block guide, said tie rod being led out of said another projection extending obliquely toward an outside of the frame, said tie rod being pivotably arranged at said sliding block, said screw means being formed by a collet arranged on said threaded section of said tie rod and said collet being supported on a said shoulder, said shoulder extending essentially at right angles to a longitudinal axis of said tie rod.

2. An embroidery frame in accordance with claim 1, wherein said head of said stud is accommodated in a stepped hole of said one projection, and said sliding block is secured against rotation within said guide, and said shoulder of said projection has an arched surface.

* * * * *